US011950650B2

(12) United States Patent
Lin

(10) Patent No.: US 11,950,650 B2
(45) Date of Patent: Apr. 9, 2024

(54) BRA FASTENER AND BRA APPLYING BRA FASTENER

(71) Applicant: King Fai Jacky Lin, Kowloon (HK)

(72) Inventor: King Fai Jacky Lin, Kowloon (HK)

( * ) Notice: Subject to any disclaimer, the term of this patent is extended or adjusted under 35 U.S.C. 154(b) by 416 days.

(21) Appl. No.: 17/311,979

(22) PCT Filed: Feb. 20, 2020

(86) PCT No.: PCT/IB2020/051414
§ 371 (c)(1),
(2) Date: Jun. 8, 2021

(87) PCT Pub. No.: WO2020/208432
PCT Pub. Date: Oct. 15, 2020

(65) Prior Publication Data

US 2022/0000202 A1 Jan. 6, 2022

(30) Foreign Application Priority Data

Apr. 11, 2019 (HK) ..... 19122190.2

(51) Int. Cl.
*A41F 1/00* (2006.01)

(52) U.S. Cl.
CPC ..... *A41F 1/006* (2013.01)

(58) Field of Classification Search
CPC ..... A41H 1/06
USPC ..... 450/28
See application file for complete search history.

(56) References Cited

U.S. PATENT DOCUMENTS

| | | | | |
|---|---|---|---|---|
| 9,642,407 | B2 * | 5/2017 | Fildan | A41F 1/006 |
| 2009/0070969 | A1 * | 3/2009 | Fildan | A41F 1/006 450/82 |
| 2010/0101058 | A1 * | 4/2010 | Fildan | A41F 1/006 24/578.14 |

(Continued)

FOREIGN PATENT DOCUMENTS

| | | | |
|---|---|---|---|
| CN | 201409464 | Y | 2/2010 |
| CN | 102006792 | A | 4/2011 |
| CN | 201782075 | U | 4/2011 |

(Continued)

*Primary Examiner* — Gloria M Hale
(74) *Attorney, Agent, or Firm* — Muncy, Geissler, Olds & Lowe, P.C.

(57) ABSTRACT

A bra fastener, comprising a first part (10) and a second part (20). The first part comprises a first connecting band (11) and a plurality of first fastening pieces (12) which are disposed at intervals at the interior of the first connecting band (11) along the length direction of the first connecting band (11), and one surface of the first connecting band (11) is provided with a through hole (111) at a position corresponding to each first fastening piece (12). The second part (20) comprises a second connecting band (21) and a second fastening piece (22) disposed at the interior of the second connecting band (21). The second fastening piece (22) partially extends from one surface of the second connecting band (21) and may pass through one of the through holes (111) on the first connecting band (11) so as to be buckled to a first fastening piece (12) corresponding to the through hole (111). When the second fastening piece (22) is partially buckled to the first fastening piece (12), the second connecting band (21) covers the first connecting band (11).

14 Claims, 8 Drawing Sheets

(56) References Cited

U.S. PATENT DOCUMENTS

| | | | | |
|---|---|---|---|---|
| 2012/0102686 | A1* | 5/2012 | Wanzenboeck | A41F 1/006 24/591.1 |
| 2021/0120893 | A1* | 4/2021 | Weng | A62B 23/025 |

FOREIGN PATENT DOCUMENTS

| | | | |
|---|---|---|---|
| CN | 203789215 | U | 8/2014 |
| CN | 203969232 | U | 12/2014 |
| CN | 203969233 | U | 12/2014 |
| CN | 204377952 | U | 6/2015 |
| CN | 105124835 | A | 12/2015 |
| CN | 207444340 | U | 6/2018 |
| CN | 208228420 | U | 12/2018 |
| JP | 2002-345512 | A | 12/2002 |
| JP | 2014-080711 | A | 5/2014 |

* cited by examiner

BRA FASTENER AND BRA APPLYING BRA FASTENER

TECHNICAL FIELD

The invention is related to the technical field of bras, in particular to a bra fastener and a bra applying this bra fastener.

BACKGROUND OF THE INVENTION

The existing bras are generally composed of two connecting bra cups, a bra fastener and two straps, the said bra fastener and the said two straps configured for connecting the said two bra cups are arranged in positions away from each other. The two bra cups and the two straps are respectively connected by shoulder straps. The bra fastener comprises first and second portions. The first portion is arranged on an outer face of an end portion of one of the two straps, and the second portion is arranged on an inner face of an end portion of another one of the two straps. The first portion comprises a first connecting member and a plurality of apertures arranged on the first connecting member, and the second portion comprises a second connecting member and a row of buckles arranged on the second portion. The two straps can be connected together by buckling the row of buckles on the second connecting member to the row of apertures on the first connecting member. The operation of the buckles and apertures is time-consuming and laborious, and the buckles and apertures are easy to be misplaced or missed, which it is inconvenient for use.

SUMMARY OF THE INVENTION

The problem to be solved in the present invention is to overcome the shortcomings of the existing technology, and to provide a bra fastener and bra applying the said bra fastener which is simple, easy and quick for operation, convenient for usage and not easy to be dislocated.

The present invention provides a bra fastener comprising a first portion and a second portion, wherein the said first portion comprises a first connecting member and a plurality of first fastening members being spacedly arranged inside and along the length of said first connecting member, a first connecting member aperture is arranged on a position of a face of the said first connecting member corresponding to the said first fastening member, the said second portion comprises a second connecting member and a second fastening member arranged inside the said second connecting member, a portion of the said second fastening member which is extending from a face of the said second connecting member and passing through the said first connecting member aperture is adapted for being mounted to the said first fastening member which is corresponding to the said first connecting member aperture, the said second connecting member is configured for covering the said first connecting member when a portion of the said second fastening member is mounted to the said first fastening member.

Typically, the said first fastening member comprises a first fastening member body, a concave member arranged on a face of the said first fastening member body distal to the corresponding first connecting member aperture and a first fastening member aperture arranged on the bottom portion of the said concave member, the said first connecting member aperture is arranged on a position of a face of the said first connecting member corresponding to the said first fastening member aperture of the said first fastening member, the said first fastening member aperture comprises two opposing first side faces extending along the length of the said first connecting member and two opposing second side faces extending along the width of the said first connecting member.

Typically, the said second fastening member comprises a second fastening member body, a fastening element arranged on a face of the said second fastening member body, the said second fastening member body is arranged inside the said second connecting member, the said fastening element which is extending from a face of the said second connecting member and passing through the said first connecting member aperture is adapted for being mounted to the said first fastening member aperture which is corresponding to the said first fastening member aperture.

Typically, the said fastening element comprises a fastening element body and two convex structures being extended from the two opposing first faces of the said fastening element body, the two said convex structures are arranged proximal to the end portion of the said fastening element body, the distance between the outer sides of the said two convex structures is longer than the distance between the inner walls of the said first fastening member aperture, the said two convex structures are respectively mounted to the two faces of the two opposing first side faces of the said concave member proximal to the said first fastening member aperture when the said first fastening member aperture is passed through by the said fastening element and the said fastening element is mounted to the said first fastening member aperture of the said first fastening member corresponding to the said first connecting member aperture, the said fastening element body is mounted inside the said first fastening member aperture, the end portion of the said fastening element and a face of the said first fastening member body distal to the said first connecting member aperture are of substantially the same plane, two respective spacings are arranged between two opposing second faces of the said fastening element body and between the said two opposing second side faces of the said first fastening member aperture, the said fastening element is adapted to be moved between the said two opposing second side faces of the said first fastening member aperture.

Typically, a passage is formed between the said two opposing second faces of the said fastening element body, an end of the said passage is extended to the end portion of the said fastening element body, another end of the said passage is proximal to the said second fastening member body, the said passage is configured to divide the said fastening element body into two separate fastening element body parts.

Typically, the cross-sectional shape of the said passage is of an inverted trapezoid shape. Typically, the distances between inner walls along the said passage is increasing along a direction towards the end portion of the said fastening element body.

Further, a fastening convex structure is arranged at a position which is proximal to the end portion of the said second face of the said fastening body part, a locking structure is integratedly formed from a face of the said concave member proximal to any one of the said second side faces of the said first fastening member aperture, the said fastening convex structure is configured to be mounted to the said fastening element when the said fastening element moves towards the corresponding locking structure of the said first fastening member.

Typically, a ring-shaped structure is mounted to an edge of the said first fastening member aperture and a face of the said first fastening member body proximal to the corresponding first connecting member aperture, the said ring-shaped structure is arranged in a position inside the corresponding first connecting member aperture.

Typically, the said first connecting member sequentially comprises first base portion, second base portion and third base portion from bottom to top, the said first fastening member is arranged between the said first and second base portions, the second and third base portions comprises the said first connecting apertures corresponding to the said fast fastening member apertures.

Typically, the said first, second and third base portions are textile portions.

Typically, the said second connecting member comprises fourth base portion, fifth base portion and sixth base portion from bottom to top, the said second fastening member body is arranged between the said fourth and fifth base portions, the said fastening element is extended from the said fifth and sixth base portions.

Typically, the said fourth, fifth and sixth base portions are textile portions.

Typically, the said textile portion is nylon portion, polyester portion, flannel portion or cotton portion.

Typically, the said first and second fastening members are made of Polyoxymethylene, Polypropylene or Polycarbonate.

Typically, the present invention comprises a bra applying the bra fastener, comprising two connecting bra cups, a bra fastener and two straps, the said bra fastener and the said two straps configured for connecting the said two bra cups are arranged in positions away from each other, the said bra fastener comprises first and second portions, the said first portion is arranged on an outer face of an end portion of one of the said two straps, the said second portion is arranged on an inner face of an end portion of another one of the said two straps, wherein the said first portion comprises a first connecting member and a plurality of first fastening members being spacedly arranged inside and along the length of said first connecting member, a first connecting member aperture is arranged on a position of a face of the said first connecting member corresponding to the said first fastening member, the said second portion comprises a second connecting member and a second fastening member arranged inside the said second connecting member, a portion of the said second fastening member which is extending from a face of the said second connecting member and passing through the said first connecting member aperture is adapted for being mounted to the said first fastening member which is corresponding to the said first connecting member aperture, the said second connecting member is configured for covering the said first connecting member when a portion of the said second fastening member is mounted to the said first fastening member.

The fastening operation of the second fastening member and the first fastening member of the invention is relatively simple, time-saving and labor-saving, easy and convenient for usage, and without worrying about misplacement and missing.

BRIEF DESCRIPTION OF DRAWINGS

This and other objects, features and advantages of the present invention will become apparent upon reading of the following detailed descriptions and drawings, in which.

DESCRIPTION OF EMBODIMENTS

Figure 1:
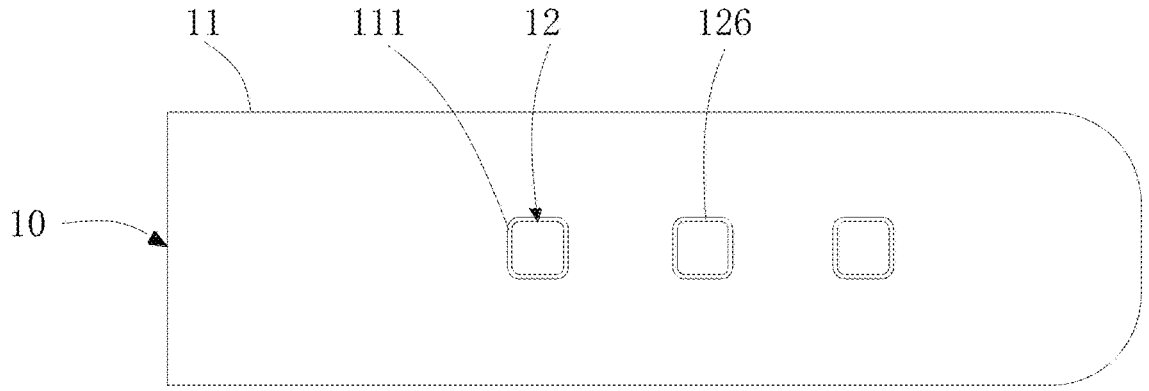
FIG. 1 shows a front view of a first portion of a bra fastener of an embodiment of the present invention.
Figure 2:
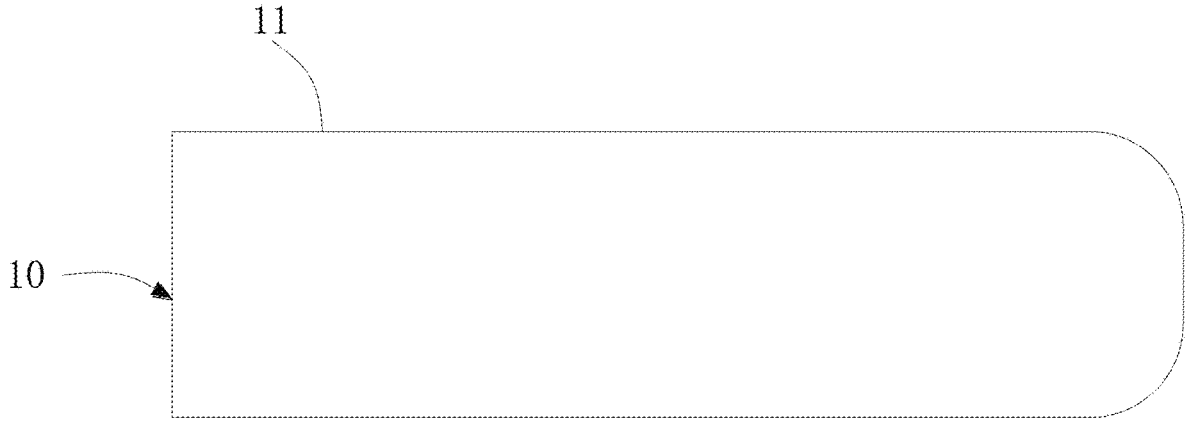
FIG. 2 shows a rear view of a first portion of FIG. 1.
Figure 3:
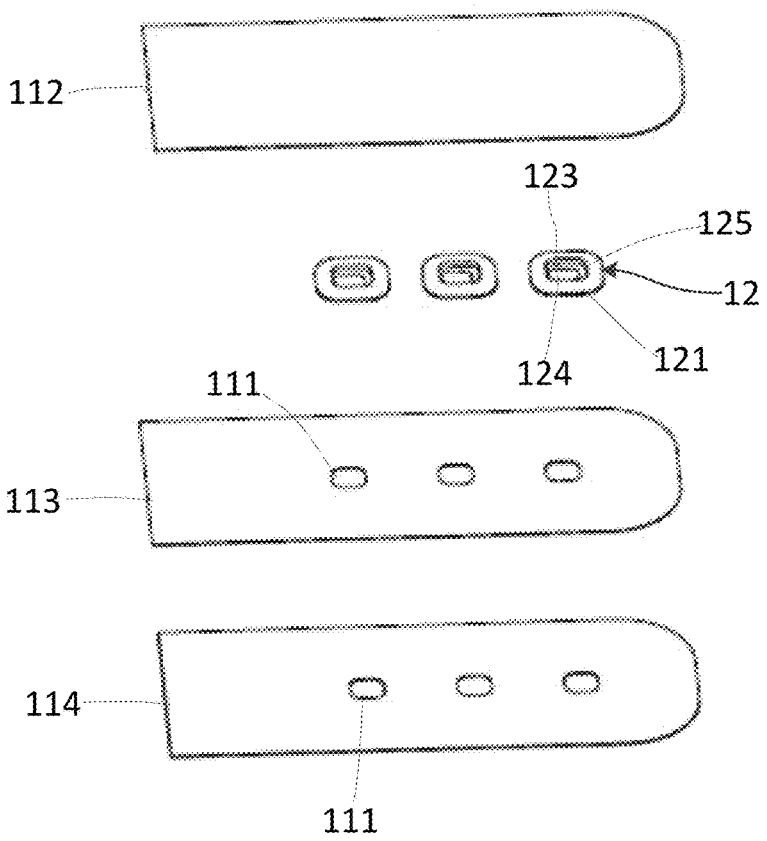
FIG. 3 shows an exploded perspective view of the first portion of FIG. 1.
Figure 4:
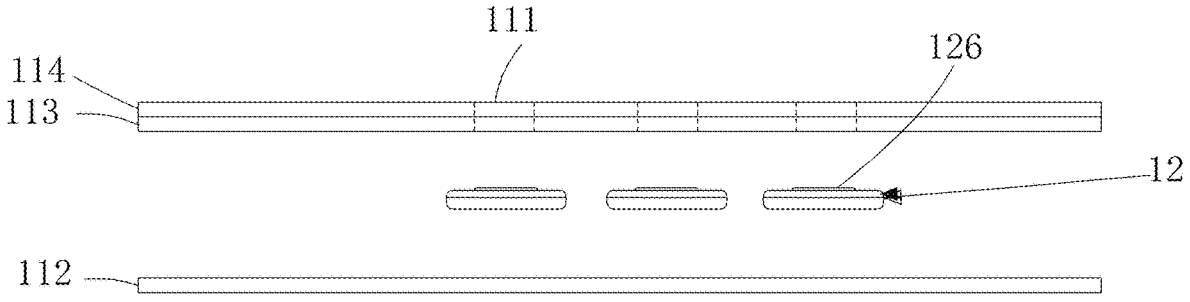
FIG. 4 shows an exploded side view of the first portion of FIG. 1.
Figure 5:
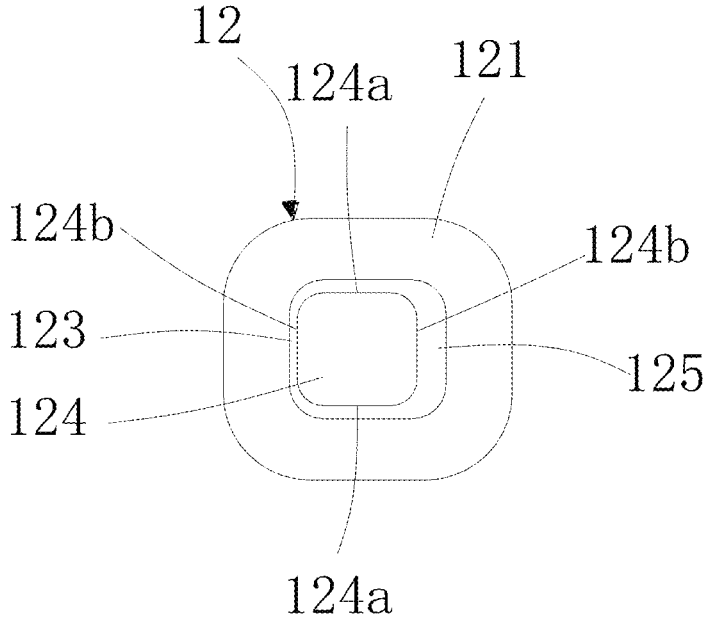
FIG. 5 shows a top view of a first fastening member of the first portion of FIG. 1.
Figure 6:
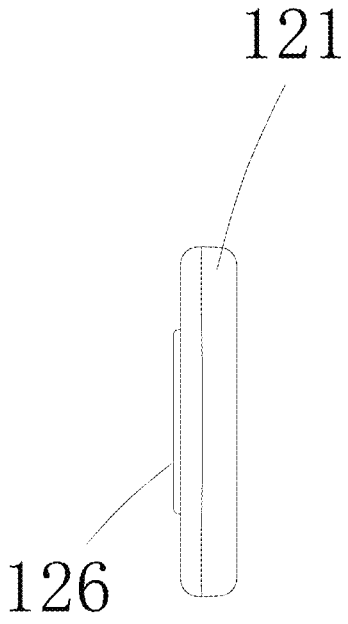
FIG. 6 shows a side view of the first fastening member of FIG. 5.
Figure 7:
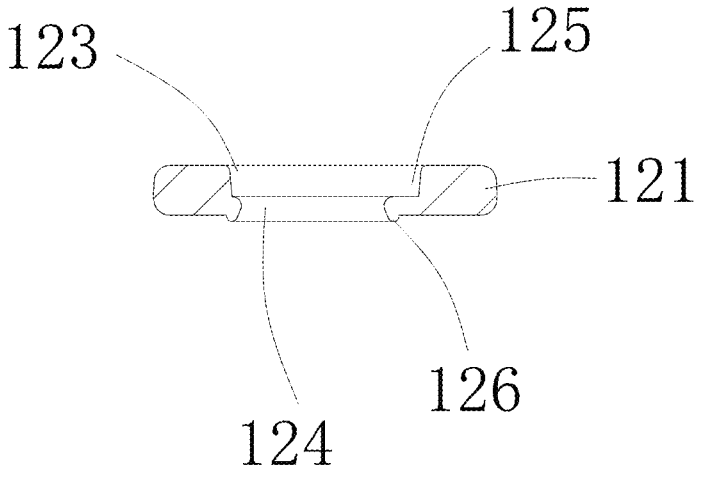
FIG. 7 shows a sectional view of the first fastening member of FIG. 5.
Figure 8:
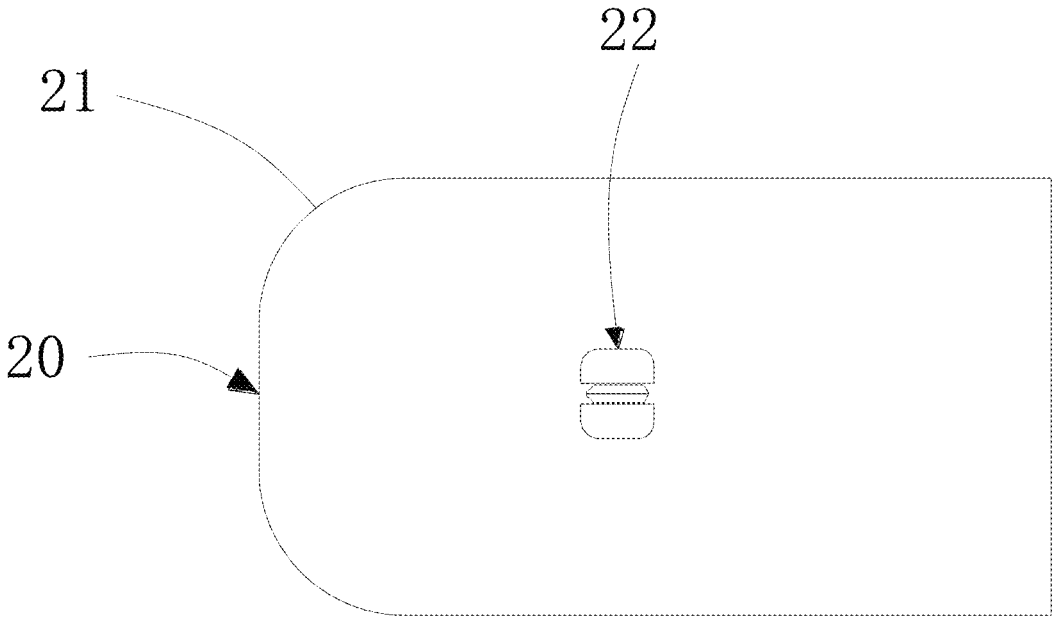
FIG. 8 shows a front view of a second portion of the bra fastener of FIG. 1.
Figure 9:
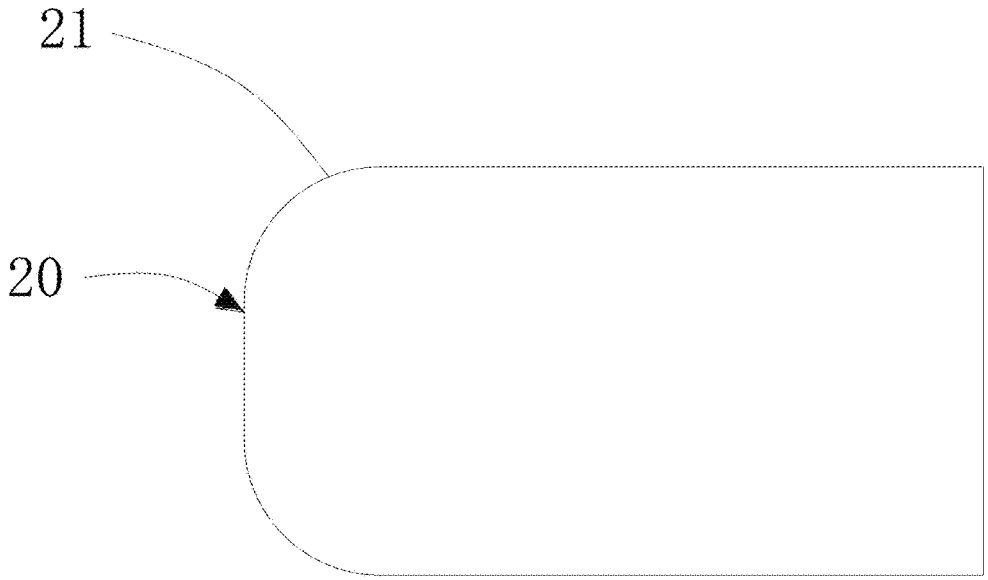
FIG. 9 shows a rear view of the back of the second portion of FIG. 8.
Figure 10:
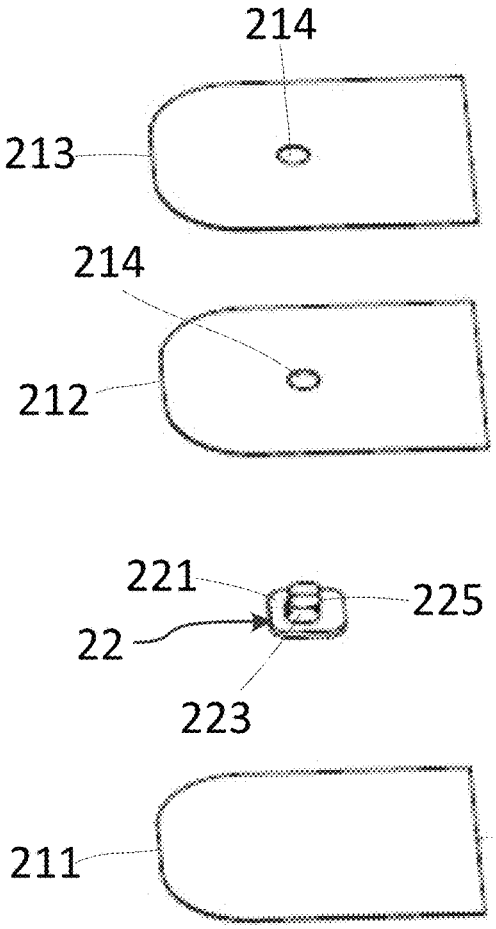
FIG. 10 shows an exploded perspective view of the second portion of FIG. 8.
Figure 11:
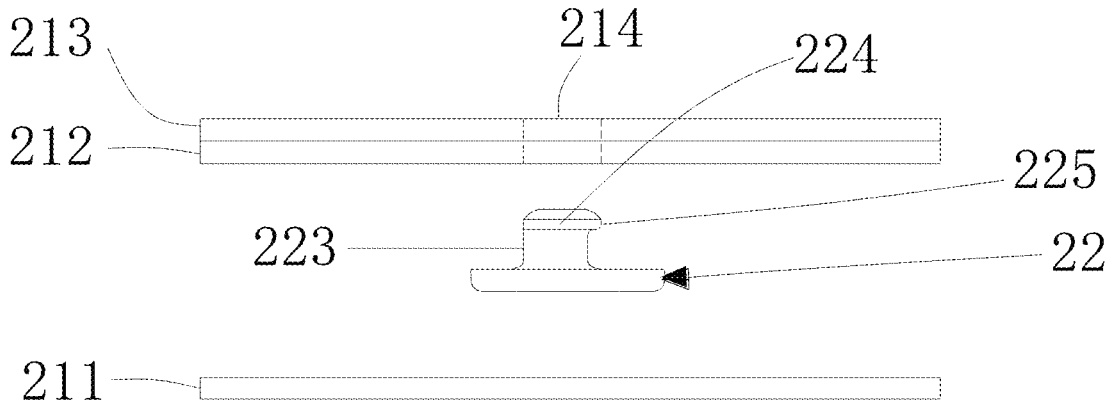
FIG. 11 shows an exploded side view of the second portion of FIG. 8.
Figure 12:
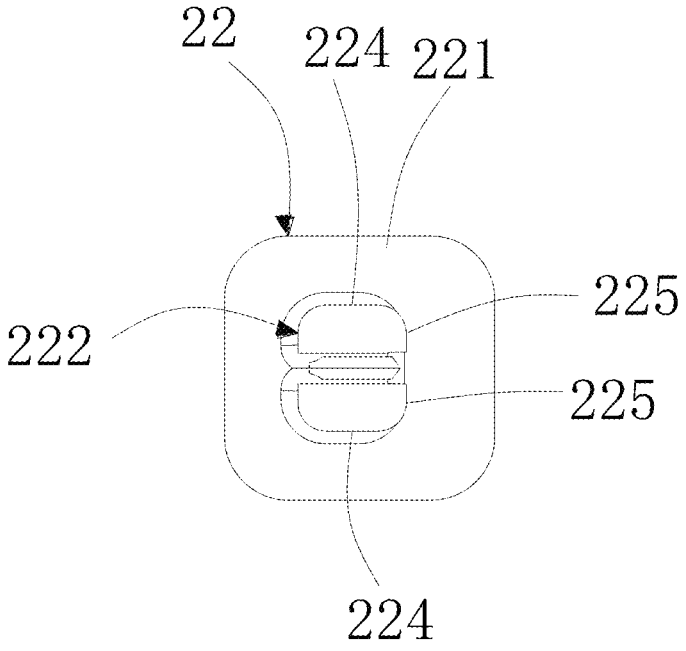
FIG. 12 shows a top view of the second fastening member of the second portion of FIG. 8.
Figure 13:
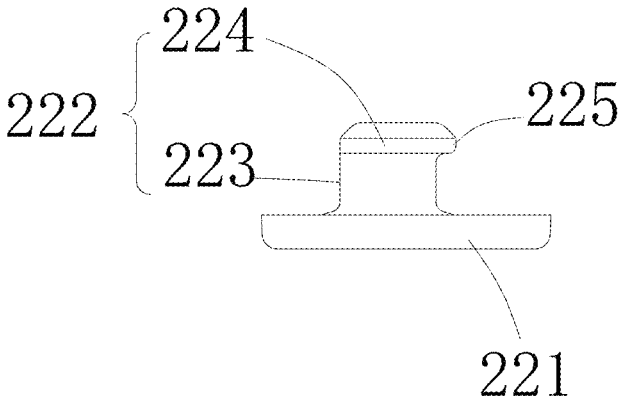
FIG. 13 shows a front view of the second fastening member of FIG. 12.
Figure 14:
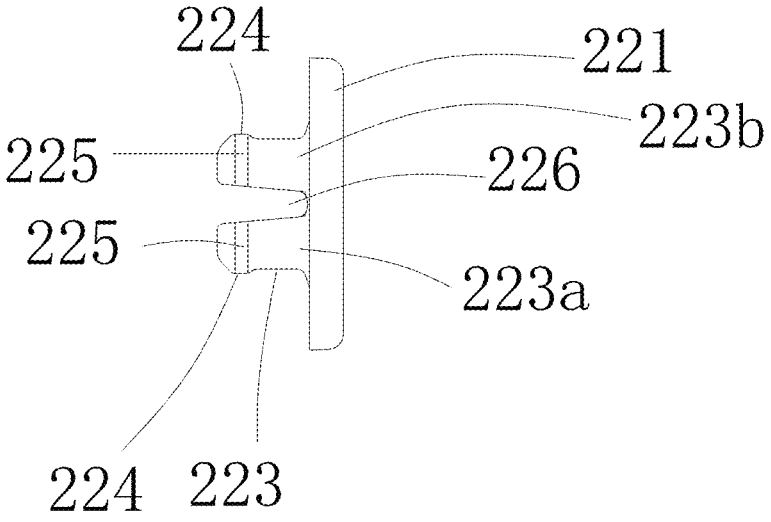
FIG. 14 shows a side view of the second fastening member of FIG. 12.

Referring to FIG. 1, FIG. 2, FIG. 8 and FIG. 9, a bra fastener provided by the present invention comprises a first portion 10 and a second portion 20.

The first portion 10 comprises a first connecting member 11 and a plurality of first fastening members 12 being spacedly arranged inside the first connecting member 11 along the length of the first connecting member 11. A square aperture 111 is arranged on a position of a face of the first connecting member 11 corresponding to the first fastening member 12. The number of the first fastening member 12 in this embodiment is three, and the number of the first fastening member 12 can be set on the basis of the actual situation.

The second portion 20 comprises a second connecting member 21 and a second fastening member 22 inside the second connecting member 21. The second fastening member 22 which is extending from a face of the second connecting member 21 and passing through the first connecting member aperture 111 is adapted for being mounted to the first fastening member 21 which is corresponding to the first connecting member 12 aperture 111. The second fastening member 22 is configured for covering the first fastening member 12 when a portion of the second connecting member 21 is mounted to the first connecting member 11. The width of the second connecting member 21 in this embodiment is equal to that of the first connecting member 11. The length of the second connecting member 21 is less than that of the first connecting member 11. The two corners at one end of the first connecting member 11 and the second connecting member 21 are provided with inverted rounded corners, which have a beautiful appearance.

Particularly, referring to FIG. 1 to FIG. 7, the first fastening member 12 comprises a first fastening member body 121, a concave member 123 arranged on a face of the first fastening member body 121 distal to the corresponding first connecting member aperture 111 and a first fastening member aperture 124 arranged on the bottom portion of the concave member 123. The first connecting member aperture 111 is arranged on a position of a face of the said first connecting member 11 corresponding to the said first fastening member aperture 124 of the first fastening member 12. The fastening member aperture 124 comprises two opposite first side faces 124*a* extending along the length of the first connecting member 11 and two opposite second side faces 124*b* extending along the width of the first connecting member 11.

In this embodiment, a ring-shaped structure 126 is mounted to an edge of the first fastening member aperture 124 and a face of the first fastening member body 121 proximal to the corresponding first connecting member aperture 111, the said ring-shaped structure 126 is arranged in a position inside the corresponding first connecting member aperture 111. The ring-shaped structure 126 is mounted to the inner wall of the corresponding connecting member aperture 111. The arrangement of the ring-shaped structure 126 plays a role in positioning the fastening member aperture 124.

Further, the first connecting member 11 sequentially comprises the first base portion 112, second base portion 113 and third base portion 114 from bottom to top. The first fastening member 12 is arranged between the first base portion 112 and second base portion 113, the second base portion 113 and third base portion 114 comprises the said first connecting apertures 111 corresponding to the fast fastening member apertures 124 of the first fastening member 12.

The first base portion 112, second base portion 113 and third base portion 114 are textile portions. The three textile portions are superimposed together by, for example, hot-pressing technology. The textile portion is nylon portion, which is convenient to manufacture and has good tensile performance. Understandably, the textile portion can also be, such as, polyester portion, flannel portion or cotton portion.

Figure 15:
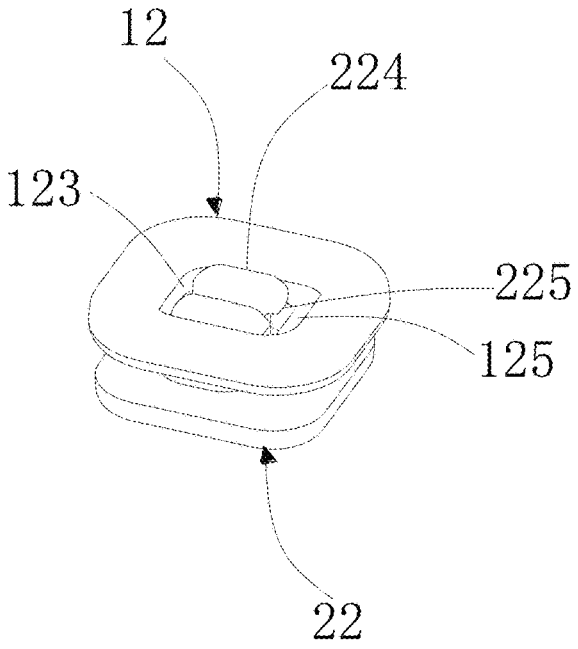
FIG. 15 shows a schematic view when the first bra fastener structure of the first portion of FIG. 1 and the second bra fastener structure of the second portion of FIG. 8 are locked with each other.

Referring to FIG. 8 to 14, the second fastening member 22 comprises a second fastening member body 221, a fastening element 222 arranged on a face of the said second fastening member body 221. The second fastening member body 221 is arranged inside the second connecting member 21, the fastening element body 222 which is extending from a face of the second connecting member 21 and passing through the first connecting member 11 aperture 111 is adapted for being mounted to the first fastening member 12 aperture 124 which is corresponding to the said first fastening member aperture 111. In actual use, the fastening element body 222 of the second fastening member 22 only needs to be aligned with one of the connecting member aperture 111 of the first connecting member 11 and pressed toward the fastening member aperture 124 of the first fastening member 12 corresponding to the connecting member aperture 111, and then the fastening element body 222 is buckled to the corresponding fastening member aperture 124. As shown in FIG. 15, compared with the existing mode of bra fasteners, the invention is simple to operate, time-saving and labor-saving, convenient for usage, easy and convenient, and without worrying about misplacement and missing.

The structures of the fastening element body 222 are described as follow. The fastening element 222 comprises a columnar fastening element body 223*a* and two convex structures 224 being extended from the two opposing first faces of the fastening element body 223, the two convex structures 224 are arranged proximal to the end portion of the fastening element body 223. The distance between the outer sides of the two convex structures 224 is longer than the distance between the inner walls of the first fastening member aperture 124, the two convex structures 224 are respectively mounted to the two faces of the two opposing first side faces 124*a* of the concave member 123 proximal to the first fastening member aperture 124 when the first fastening member aperture 111 of the first connecting member 11 is passed through by the fastening element 222 and the fastening element is mounted to the fastening member aperture 124 of the first fastening member 12 corresponding to the first connecting member aperture 111, the fastening element body 223 is mounted inside the distant fastening member aperture 124, the end portion of the fastening element body 223 and a face of the first fastening member body 121 distal to the first connecting member aperture 111 are of substantially the same plane, two respective spacings are arranged between two opposing second faces of the fastening element body 223 and between the two opposing second side 124*b* faces of the fastening member aperture 124, the fastening element 222 is adapted to be moved between the two opposing second side faces 124*b* of the first fastening member aperture 124. In actual application, the fastening element 222 can move between the two opposite second sides 124*b* of the fastening member aperture 124 only by pulling the second connecting member 21.

A passage 226 is formed between the two opposing second faces of the fastening element body 223. An end of the passage 226 is extended to the end portion of the fastening element body 223, another end of the said passage is proximal to the second fastening member body 221. The passage 226 is configured to divide the fastening element body 223 into two separate fastening element body parts, 223*a*, 223*b*. With this structural design, in the process of fastening the fastening element body 223 to the corresponding fastening member aperture 124, since the distance between the outer sides of the two convex structures 224 is larger than the inner diameter of the fastening member aperture 124, the two convex structures 224 will be squeezed by the two opposite first sides 124*a* of the fastening member aperture 124, and the ends of the two branches 223*a* and 223*b* will move towards each other under the action of their own elastic force, so that the two convex structures 224 can smoothly pass through the fastening member aperture 124. When the two convex structures 224 pass through the fastening member aperture 124, the two convex structures 224 will be clamped to both sides of the two opposite first sides 124*a* of the concave member 123 near the fastening member aperture 124. At this time, the two branches 223*a* and 223*b* will return to their original positions under the action of their own elastic force, and the fastening element body 223 will pass through the fastening member aperture 124, thus the fastening element body 222 will snap into the corresponding fastening member aperture 124. The depth of the passage 226 determines the elastic force of the separate fastening element body parts, 223*a*, 223*b*.

Preferably, the cross-sectional shape of the passage 226 is of an inverted trapezoid shape. The distances between inner walls along the passage 226 is increasing along a direction towards the end portion of the fastening element body 223. The elastic force of the separate fastening element body parts, 223*a*, 223*b* can be further increased.

Further, in order to fastening element body 222 of the second fastening member 22 to the first fastening member 12 to prevent the fastening element body 222 of the second fastening member 22 from moving, a fastening convex structure 225 is arranged at a position which is proximal to the end portion of the second face of the fastening body part 223*a* and 223*b*, a locking structure 125 is integratedly formed from a face of the concave member 123 proximal to any one of the second side 124*b* faces of the first fastening member aperture 124, the fastening convex structure 225 is configured to be mounted to the fastening element 222 when the fastening element 222 moves towards the corresponding locking structure 125 of the first fastening member 12. In practical application, the fastening element body 222 of the second connecting member 22 can be fastened to the first fastening member 12 only by pulling the second connecting member 21 to drive the fastening element body 222 to move toward the corresponding fastener position 125 of the first fastening member 12, so that the fastening convex structure 225 is fastened to the corresponding locking structure 125, and the operation is simple and convenient.

In this embodiment, the second connecting member 21 comprises fourth base portion 211, fifth base portion 212, and sixth base portion 213 from bottom to top. The second fastening member body 221 is arranged between the fourth base portion 211 and the fifth base portion 212, and the fastening element body 222 is extended from the fifth base portion 212 and the sixth base portion 213. The fifth base portion 212 and the sixth base portion 213 have protrusion holes 214 through which fastening element body 222 protrudes.

The fourth base portion 211, the fifth base portion 212, and the sixth base portion 213 are all textile portions. The three textile portions are superimposed together by, for example, hot-pressing technology. The textile portion is nylon portion, which is convenient to manufacture and has good tensile performance. Understandably, the textile portion can also be, such as, polyester portion, flannel portion or cotton portion.

The first fastening member 12 and the second fastening member 22 of this embodiment are made of POM (polyformaldehyde, which is thermoplastic crystalline polymer), which has good tensile properties and dyeing properties and is convenient to manufacture. It is understood that the material of the first fastening member 12 and the second fastening member 22 may also be, for example, a PP (polypropylene, which is a semi-crystalline thermoplastic plastic material) or PC (polycarbonate, which is a high-molecular polymer containing carbonate groups in the molecular chain) plastic material.

The fastening element body 222 of the second fastening member 22 of the invention is mounted to the corresponding first fastening member 12 as follows. The fastening element body 222 of the second fastening member 22 is aligned with one of the connecting member aperture 111 of the first connecting member 11 and pressed against the fastening member aperture 124 of the first fastening member 12 corresponding to the connecting member aperture 111. Until the two convex structures 224 of the fastening element body 222 pass through the fastening member aperture 124 and are respectively clamped to both sides of the two opposite first sides 124*a* of the concave member 123 close to the fastening member aperture 124, and the fastening element body 223 of the fastening element body 222 passes through the fastening member aperture 124, then the fastening element body 222 is fastened to the corresponding fastening member aperture 124, that is, the fastening element body of the second fastener 22 is fastened to the corresponding first fastener 12. In order to fasten the fastening element body 222 of the second fastening member 22 to the first fastening member 12, when the fastening element body 222 of the second fastening member 22 is fastened to the corresponding fastening member aperture 124, the second connecting member 22 is pulled to move the fastening element body 222 toward the corresponding locking structure 125 until the fastening convex structure 225 of the fastening element body 222 is fastened to the locking structure 125. At this time, the fastening element body 222 of the second fastening member 22 is fastened to the first fastening member 12.

Figure 16:
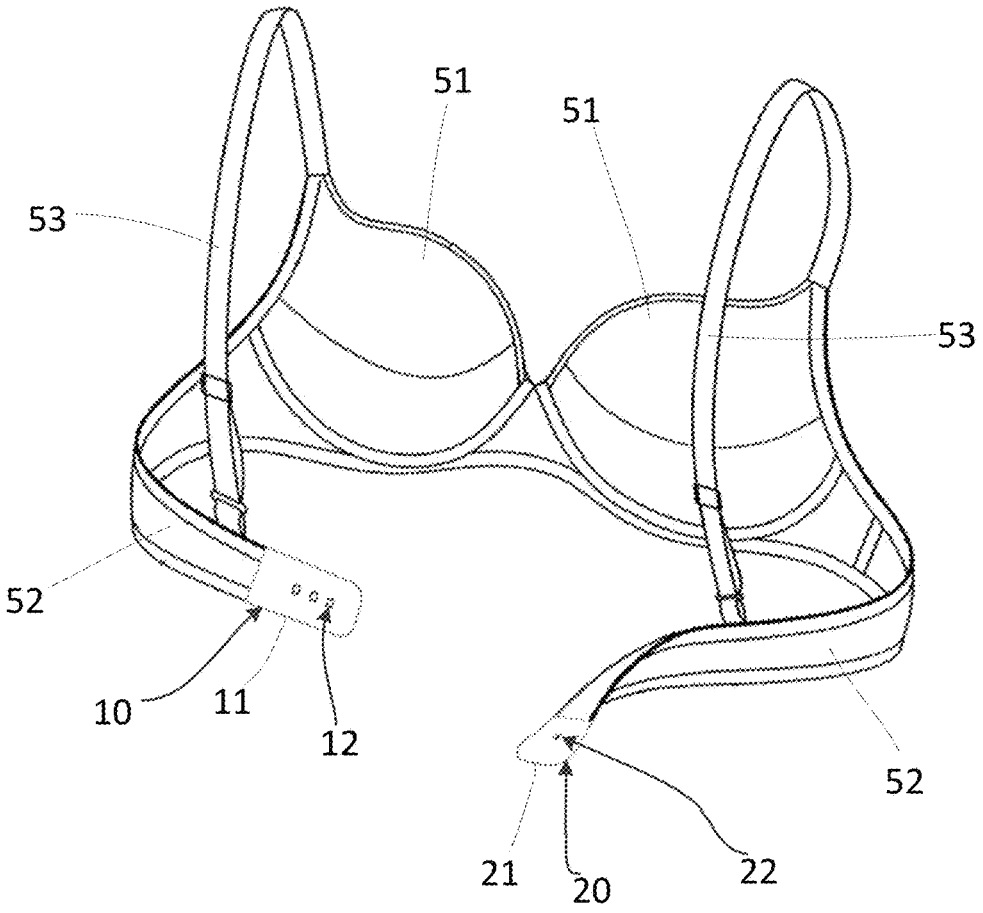
FIG. 16 shows a schematic view of a bra to which the bra fastener of the present invention is applied.

FIG. 16 is a bra to which the bra fastener of the invention is applied. The bra is an inner wearing bra, comprising two connecting bra cups 51, a bra fastener and two straps 52. The bra fastener and the two straps configured for connecting the two bra cups 51 are arranged in positions away from each other. The two bra cups 51 and the two straps 52 are connected by shoulder straps 53, respectively. The bra fastener comprises the first portion 10 and the second portion 20, wherein the first portion 10 is arranged on an outer face of an end portion of one of the said two straps 52, and the second portion 20 is arranged on an inner face of an end portion of another one of the said two straps 52.

The locking structure 125 of the first fastening member 12 in this embodiment is located on the second side of the fastening member aperture 124 away from the bra cup 51. In actual wearing, the fastening element body 222 of the second fastening member 22 on the second connecting member 21 is aligned with one of the connecting member aperture 111 of the first connecting member 11 and pressed toward the corresponding fastening member aperture 124 of the first fastening member 12 until the fastening element body 222 of the second fastening member 22 snaps into the fastening member aperture 124 of the first fastening member 21. At this time, the second connecting member 21 is configured for covering the first connecting member 11 and connects the two back straps 52 together. After the fastening element body 222 of the second fastening member 22 is fastened to the corresponding fastening member aperture 124 of the first fastening member 12, the strap 51 on which the second connecting member 21 is set is pulled away from the first connecting member 11 until the fastening convex structure 225 of the second fastening member 22 is fastened to the locking structure 125 of the first fastener 12. At this time, the bra is worn. In this embodiment, there are three first fastening members 12, and the fastening element body 222 of the second fastening member 22 is respectively fastened with the fastening member aperture 124 of the three first fastening members 12 to obtain three different chest sizes. In actual use, the first fastening member 12 to be fastened can be selected according to the actual chest size of the user. The bra of the invention is convenient to wear, simple to operate, time-saving and labor-saving.

The present invention has been described in detail, with reference to the preferred embodiment, in order to enable the reader to practice the invention without undue experimentation. However, a person having ordinary skill in the art will readily recognizes that many of the previous disclosures may be varied or modified somewhat without departing from the spirit and scope of the invention. Accordingly, the intellectual property rights to this invention are defined only by the following claims.

What is claimed is:

1. A bra fastener comprising a first portion and a second portion, wherein the said first portion comprises a first connecting member and a plurality of first fastening members being spacedly arranged inside and along a length of said first connecting member, a first connecting member aperture is arranged on a position of a face of the said first connecting member corresponding to the said first fastening member, the said second portion comprises a second connecting member and a second fastening member arranged inside the said second connecting member, a portion of the said second fastening member which is extending from a face of the said second connecting member and passing through the said first connecting member aperture is adapted for being mounted to the said first fastening member which is corresponding to the said first connecting member aperture, the said second connecting member is configured for covering the said first connecting member when a portion of the said second fastening member is mounted to the said first fastening member, wherein the said first fastening member comprises a first fastening member body, a concave member arranged on a face of the said first fastening member body distal to the corresponding first connecting member aperture and a first fastening member aperture arranged on a bottom portion of the said concave member, the said first connecting member aperture is arranged on a position of a face of the said first connecting member corresponding to the said first fastening member aperture of the said first fastening member, the said first fastening member aperture comprises two opposing first side faces extending along the length of the said first connecting member and two opposing second side faces extending along a width of the said first connecting member, wherein the said second fastening member comprises a second fastening member body, a fastening element arranged on a face of the said second fastening member body, the said second fastening member body is arranged inside the said second connecting member, the said fastening element which is extending from a face of the said second connecting member and passing through the said first connecting member aperture is adapted for being mounted to the said first fastening member aperture which is corresponding to the said first fastening member aperture, wherein the said fastening element comprises a fastening element body and two convex structures being extended from the two opposing first faces of the said fastening element body, the two said convex structures are arranged proximal to an end portion of the said fastening element body, a distance between outer sides of the said two convex structures is longer than a distance between inner walls of the said first fastening member aperture, the said two convex structures are respectively mounted to the two faces of the two opposing first side faces of the said concave member proximal to the said first fastening member aperture when the said first fastening member aperture is passed through by the said fastening element and the said fastening element is mounted to the said first fastening member aperture of the said first fastening member corresponding to the said first connecting member aperture, the said fastening element body is mounted inside the said first fastening member aperture, an end portion of the said fastening element and a face of the said first fastening member body distal to the said first connecting member aperture are of substantially a same plane, two respective spacings are arranged between two opposing second faces of the said fastening element body and between the said two opposing second side faces of the said first fastening member aperture, the said fastening element is adapted to be moved between the said two opposing second side faces of the said first fastening member aperture.

2. The bra fastener according to claim 1, wherein a passage is formed between the said two opposing second faces of the said fastening element body, an end of the said passage is extended to the end portion of the said fastening element body, another end of the said passage is proximal to the said second fastening member body, the said passage is configured to divide the said fastening element body into two separate fastening element body parts.

3. The bra fastener according to claim 2, wherein a cross-sectional shape of the said passage is of an inverted trapezoid shape.

4. The bra fastener according to claim 2, wherein distances between inner walls along the said passage is increasing along a direction towards the end portion of the said fastening element body.

5. The bra fastener according to claim 2, wherein a fastening convex structure is arranged at a position which is proximal to an end portion of the said second face of the said fastening body part, a locking structure is integratedly formed from a face of the said concave member proximal to any one of the said second side faces of the said first fastening member aperture, the said fastening convex structure is configured to be mounted to the said fastening element when the said fastening element moves towards corresponding locking structure of the said first fastening member.

6. The bra fastener according to claim 1, wherein a ring-shaped structure is mounted to an edge of the said first fastening member aperture and a face of the said first fastening member body proximal to the corresponding first connecting member aperture, the said ring-shaped structure is arranged in a position inside the corresponding first connecting member aperture.

7. The bra fastener according to claim 1, wherein the said first connecting member sequentially comprises first base portion, second base portion and third base portion from bottom to top, the said first fastening member is arranged between the said first and second base portions, the second and third base portions comprises the said first connecting apertures corresponding to the said fast fastening member apertures.

8. The bra fastener according to claim 7, wherein the said first, second and third base portions are textile portions.

9. The bra fastener according to claim 1, wherein the said second connecting member comprises fourth base portion, fifth base portion and sixth base portion from bottom to top, the said second fastening member body is arranged between the said fourth and fifth base portions, the said fastening element is extended from the said fifth and sixth base portions.

10. The bra fastener according to claim 9, wherein the said fourth, fifth and sixth base portions are textile portions.

11. The bra fastener according to claim 8, wherein the said textile portion is nylon portion, polyester portion, flannel portion or cotton portion.

12. The bra fastener according to claim 1, wherein the said first and second fastening members are made of Polyoxymethylene, Polypropylene or Polycarbonate.

13. A bra applying the bra fastener of claim 1, comprising two connecting bra cups, a bra fastener and two straps, the said bra fastener and the said two straps configured for connecting the said two bra cups are arranged in positions away from each other, the said bra fastener comprises first and second portions, the said first portion is arranged on an outer face of an end portion of one of the said two straps, the said second portion is arranged on an inner face of an end portion of another one of the said two straps, wherein the said first portion comprises a first connecting member and a plurality of first fastening members being spacedly arranged inside and along the length of said first connecting member, a first connecting member aperture is arranged on a position of a face of the said first connecting member corresponding to the said first fastening member, the said second portion comprises a second connecting member and a second fastening member arranged inside the said second connecting member, a portion of the said second fastening member which is extending from a face of the said second connecting member and passing through the said first connecting member aperture is adapted for being mounted to the said first fastening member which is corresponding to the said first connecting member aperture, the said second connecting member is configured for covering the said first connecting member when a portion of the said second fastening member is mounted to the said first fastening member.

14. The bra fastener according to claim 10, wherein the said textile portion is a nylon portion, polyester portion, flannel portion or cotton portion.

* * * * *